US008454769B2

(12) United States Patent
Erickson et al.

(10) Patent No.: US 8,454,769 B2
(45) **Date of Patent: *Jun. 4, 2013**

(54) NON-TOXIC PERCUSSION PRIMERS AND METHODS OF PREPARING THE SAME

(75) Inventors: Jack Erickson, Andover, MN (US); Joel L. Sandstrom, Corcoran, MN (US); Gene Johnston, Radford, VA (US); Neal Norris, Lewiston, ID (US); Patrick Braun, Clarkston, WA (US); Reed Blau, Richmond, UT (US); Lisa Spendlove Liu, Layton, UT (US); Rachel Hendrika Newell, Ogden, UT (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/456,920

(22) Filed: Apr. 26, 2012

(65) Prior Publication Data

US 2012/0227874 A1 Sep. 13, 2012

Related U.S. Application Data

(63) Continuation of application No. 12/029,084, filed on Feb. 11, 2008, now Pat. No. 8,192,568, which is a continuation-in-part of application No. 11/704,530, filed on Feb. 9, 2007, now Pat. No. 8,202,377.

(51) Int. Cl.

| | |
|---|---|
| ***C06B 33/00*** | (2006.01) |
| ***C06B 33/08*** | (2006.01) |
| ***D03D 23/00*** | (2006.01) |
| ***D03D 43/00*** | (2006.01) |

(52) U.S. Cl.
USPC ..... 149/108.6; 149/37; 149/38; 149/109.2; 149/109.4

(58) Field of Classification Search
USPC ..... 149/37, 38, 108.6, 109.2, 109.4
See application file for complete search history.

(56) References Cited

U.S. PATENT DOCUMENTS

| | | | | |
|---|---|---|---|---|
| 998,007 | A | 7/1911 | Imperiali | |
| 2,194,480 | A | 3/1940 | Pritham et al. | |
| 2,231,946 | A | 2/1941 | Rechel et al. | |
| 2,349,048 | A * | 5/1944 | Mackey et al. | 149/11 |
| 2,649,047 | A | 8/1953 | Silverstein | |

(Continued)

FOREIGN PATENT DOCUMENTS

| | | |
|---|---|---|
| DE | 2513735 | 10/1975 |
| DE | 19606237 | 8/1996 |

(Continued)

OTHER PUBLICATIONS

Nordblom et al., Frankford Arsenal Report No. R-206; The Stabilization of Commerical Red Phosphorus Final Report, Research Item No. 202.14, Frankford Arsenal Library. Apr. 1943.

(Continued)

*Primary Examiner* — James McDonough
(74) *Attorney, Agent, or Firm* — Christensen Fonder P.A.

(57) ABSTRACT

A percussion primer composition including at least one explosive, at least fuel particle having a particle size of about 1500 nm or less, at least one oxidizer, optionally at least one sensitizer, optionally at least one buffer, and to methods of preparing the same.

50 Claims, 6 Drawing Sheets

U.S. PATENT DOCUMENTS

| | | | | |
|---|---|---|---|---|
| 2,929,699 | A | 3/1960 | Audrieth et al. | |
| 2,970,900 | A | 2/1961 | Woodring et al. | |
| 3,026,221 | A | 3/1962 | Krist | |
| 3,113,059 | A | 12/1963 | Ursenbach | |
| 3,181,463 | A | 5/1965 | Morgan et al. | |
| 3,275,484 | A | 9/1966 | Foote et al. | |
| 3,367,805 | A | 2/1968 | Clay et al. | |
| 3,420,137 | A | 1/1969 | Staba | |
| 3,437,534 | A | 4/1969 | McEwan et al. | |
| 3,488,711 | A | 1/1970 | Dany et al. | |
| 3,634,153 | A | 1/1972 | Perkins et al. | |
| 3,650,856 | A | 3/1972 | Artz | |
| 3,707,411 | A | 12/1972 | Gawlick et al. | |
| 3,726,217 | A | 4/1973 | Dedman et al. | |
| 3,755,019 | A | 8/1973 | Huskins et al. | |
| 3,767,488 | A | 10/1973 | Seals | |
| 3,904,451 | A | 9/1975 | Rainone | |
| 4,014,719 | A | 3/1977 | Wells | |
| 4,133,707 | A | 1/1979 | Andrew | |
| 4,142,927 | A | 3/1979 | Walker et al. | |
| 4,145,969 | A | 3/1979 | Gawlick et al. | |
| 4,196,026 | A | 4/1980 | Walker et al. | |
| 4,304,614 | A | 12/1981 | Walker et al. | |
| 4,315,897 | A | 2/1982 | Staendeke et al. | |
| 4,336,085 | A | 6/1982 | Walker et al. | |
| 4,428,292 | A | 1/1984 | Riggs | |
| 4,522,665 | A | 6/1985 | Yates, Jr. et al. | |
| 4,554,031 | A | 11/1985 | Kerviel et al. | |
| 4,581,082 | A | 4/1986 | Hagel et al. | |
| 4,698,215 | A | 10/1987 | Albanesi et al. | |
| 4,728,375 | A | 3/1988 | Simpson | |
| 4,853,288 | A | 8/1989 | Staendeke et al. | |
| 4,963,201 | A | 10/1990 | Bjerke et al. | |
| 4,976,793 | A | 12/1990 | Zimmerman | |
| 5,027,707 | A | 7/1991 | Mei | |
| 5,167,736 | A | 12/1992 | Mei et al. | |
| 5,216,199 | A | 6/1993 | Bjerke et al. | |
| 5,316,600 | A | 5/1994 | Chan et al. | |
| 5,388,519 | A | 2/1995 | Guindon et al. | |
| 5,417,160 | A | 5/1995 | Mei et al. | |
| 5,449,423 | A | 9/1995 | Cioffe | |
| 5,466,315 | A | 11/1995 | Erickson et al. | |
| 5,522,320 | A | 6/1996 | Dillehay | |
| 5,557,061 | A | 9/1996 | Ramaswamy | |
| 5,567,252 | A | 10/1996 | Mei et al. | |
| 5,610,367 | A | 3/1997 | Erickson et al. | |
| 5,672,219 | A | 9/1997 | Rinaldi et al. | |
| 5,684,268 | A | 11/1997 | Lopata | |
| 5,717,159 | A | 2/1998 | Dixon et al. | |
| 5,780,768 | A | 7/1998 | Knowlton et al. | |
| 5,831,208 | A | 11/1998 | Erickson | |
| 5,939,661 | A | 8/1999 | Bayliss | |
| 6,057,264 | A | 5/2000 | Bradbury | |
| 6,066,214 | A | 5/2000 | Comfort | |
| 6,165,294 | A | 12/2000 | Fogelzang et al. | |
| 6,322,648 | B2 | 11/2001 | Rayer et al. | |
| 6,478,903 | B1 | 11/2002 | John, Jr. et al. | |
| 6,544,363 | B1 | 4/2003 | Erickson | |
| 6,581,520 | B1 | 6/2003 | Koch et al. | |
| 6,588,344 | B2 | 7/2003 | Clark et al. | |
| 6,612,242 | B2 | 9/2003 | Raupp et al. | |
| 6,620,267 | B1 | 9/2003 | Guindon et al. | |
| 6,641,683 | B1 | 11/2003 | McKenney, Jr. et al. | |
| 6,645,625 | B2 | 11/2003 | Horold et al. | |
| 6,663,731 | B1 | 12/2003 | Rose et al. | |
| 6,878,221 | B1 * | 4/2005 | Mei et al. | 149/41 |
| 7,129,348 | B1 | 10/2006 | Wardle et al. | |
| 7,192,649 | B1 | 3/2007 | Jouet et al. | |
| 7,670,446 | B2 | 3/2010 | Puszynski et al. | |
| 7,670,466 | B2 * | 3/2010 | Lee | 204/224 M |
| 8,192,568 | B2 | 6/2012 | Erickson et al. | |
| 8,202,377 | B2 * | 6/2012 | Erickson et al. | 149/109.6 |
| 8,206,522 | B2 | 6/2012 | Sandstrom et al. | |
| 2002/0127403 | A1 | 9/2002 | Horold et al. | |
| 2002/0129724 | A1 * | 9/2002 | Clark et al. | 102/307 |
| 2005/0183805 | A1 | 8/2005 | Pile et al. | |
| 2005/0189053 | A1 * | 9/2005 | Pile et al. | 149/108.6 |
| 2005/0224147 | A1 | 10/2005 | Jung et al. | |
| 2006/0060273 | A1 | 3/2006 | Smith | |
| 2006/0113014 | A1 * | 6/2006 | Puszynski et al. | 149/40 |
| 2006/0219341 | A1 | 10/2006 | Johnston et al. | |
| 2006/0272756 | A1 | 12/2006 | Kneisl et al. | |
| 2007/0102076 | A1 | 5/2007 | Redecker et al. | |
| 2008/0245252 | A1 * | 10/2008 | Erickson et al. | 102/204 |
| 2010/0116385 | A1 | 5/2010 | Johnston et al. | |
| 2011/0000390 | A1 | 1/2011 | Erickson et al. | |
| 2011/0239887 | A1 | 10/2011 | Sandstrom et al. | |

FOREIGN PATENT DOCUMENTS

| | | |
|---|---|---|
| EP | 0070932 | 2/1983 |
| EP | 0283759 | 9/1988 |
| EP | 0334725 | 9/1989 |
| EP | 0699646 | 3/1996 |
| EP | 0911366 | 4/1999 |
| EP | 0952130 | 10/1999 |
| EP | 1195366 | 4/2002 |
| EP | 1443034 | 8/2004 |
| EP | 0737174 | 9/2004 |
| WO | WO9515298 | 6/1995 |
| WO | WO9612770 | 5/1996 |
| WO | WO9944968 | 9/1999 |
| WO | WO0121558 | 3/2001 |
| WO | WO0206421 | 1/2002 |
| WO | WO2006009579 | 1/2006 |
| WO | WO2006083379 | 8/2006 |
| WO | WO2008/100252 | 8/2008 |
| WO | WO2009/079788 | 7/2009 |
| WO | WO2009/102338 | 8/2009 |
| WO | WO2011/123437 | 10/2011 |

OTHER PUBLICATIONS

United States Army, Small Caliber Ammunition Test Procedures 5.56 mm Cartridges, Picatinny Arsenal, New Jersey, Nov. 1998. pp. 1-191.

Eisentrager, Frank, "Key Parameters for the Stability of Red Phosphorous", 31st International Pyrotechnic Seminar Proceedings, Jul. 2004. Colorado Springs, Colorado. Copyright 2000 IPSUSA.

Ratcliff, Andrew, "Review of Six Generations of Red Phosphorous 1950-1999 and Beyond", 27th International Pyrotechnic Seminar Proceedings, Jul. 2000. Grand Junction Colorado. Copyright 2000. IPSUSA.

Horoeld et al, "Commerical Developments in Red Phosphorous Performance and Stability for Pyrotechnics", Journal of Pyrotechnics, Issue 12. Summer 2001. Copyright 2001. IPS.

Collins et al., "The Use of Red Phosphorous in Pyrotechnics—Results of an International Investigation". 31st International Pyrotechnics Seminar Proceedings. Jul. 2004. Colorado Springs, Colorado. Copyright 2002. IPSUSA.

European Search Report for European Application No. EP07004155 dated Jul. 16, 2007.

Alenfelt, "Corrosion protection of magnesium without the use of chromates", Pyrotechnica XVI (Aug. 1995), pp. 44-49. Pyrotechnia Publications, Austin, Texas.

Muller, "Citric acid as corrosion inhibitor for aluminum pigment", Corrosion Science, vol. 46, No. 1. Jan. 2004. p. 159-167.

International Search Report and Written Opinion of International Application No. PCT/US2008/068275 date of mailing Jan. 13, 2009.

International Search Report and Written Opinion of International Application No. PCT/US2007/003806 date of mailing Jan. 13, 2009.

European Office Action of European Application No. 07870653.8 dated Feb. 21, 2011.

Canadian Office Action of Canadian Application No. 2668123 dated Aug. 15, 2011.

Busky, et al., "Non-Toxic Heavy Metal Free Primers for Small Arms Cartridges—Red Phosphorous Base", presented May 8, 2007.

Definition of "composition", Hackh's Chemical Dictionary, 4th Edition. Copyright 1969 by Mc-Graw Hill, Inc. New York, NY.

Definition of "mixture", The American Heritage College Dictionary, 3rd Edition. Copyright 2000 by Houghton Mifflin.

Horold, Sebastian, "Improvements in Stability of Red Phosphorous", 27th International Pyrotechnic Seminar Proceedings, Jul. 2000, Grand Junction Colorado, Copyright 2000 IPSUSA.

Levitas, Valery I, et al., "Mechanochemical mechanism for fast reaction of metastable intermolecular composites based on dispersion of liquid metal", J. Appl. Phys. vol. 101, pp. 083524-1 through 083524-20, 2007.
Railsback, Bruce, "An Earth scientist's periodic table of the elements and their ions," Geology, pp. 737-740, Sep. 2003.
Railsback, Bruce, "An earth scientist's periodic table of the elements and their ions," Version 4.8, University of Georgia, Athens, Georgia, Copyright 2007. http://www.gly.uga.edu/railsback/PT.html.
Rovner, Sophie, "How a Lubricant Additive Works", chemical & Engineering News, vol. 83, No. 11, p. 10 Copyright 2005.
Ostrowski et al., "AL/MoO3 Primer Evaluation Tests Part II: Delay Cartridges," American Institute of Aeronautics and Astronautics, AIAA/ASME/SAE/ASEE Joint Propulsion Conference, Huntsville, AL 2000. Paper 2000-3647.
Ostrowski et al., "Recent Accomplishments in MIC Primer Development at NSWC/Indian Head," Paper 2005-3514, AIAA 41st Joint Propulsion Conference, Tucson, AZ 2005.
Ostrowski et al., "Nano Energetics for US Navy Percussion Primer Applications", Energetic Materials Technology. pp. 1-6. 2006.
Stevenson et al., Frankford Arsenal Report No. R-265; Caliber .30 Red Phosphorus Primers, Third Report Research Item No. 204.0, Frankfort Arsenal Library, Feb. 1943.
Application and File History for U.S. Appl. No. 12/751,607, filed Mar. 31, 2010, inventor Sandstrom et al.
Application and File History for U.S. Appl. No. 12/029,084, filed Feb. 11, 2008, inventor Erickson.
Application and File History for U.S. Appl. No. 11/704,530, filed Feb. 9, 2007, inventor Erickson.
Application and File History for U.S. Appl. No. 12/559,218, filed Sep. 14, 2009, inventor Johnston.
Application and File History for U.S. Appl. No. 11/093,633, filed Mar. 30, 2005, inventor Johnston.

* cited by examiner

ALEX ALUMINUM IN DISTILLED WATER

SIMULATED BULK AUTOIGNITION TEMPERATURE (SBAT)

ALEX ALUMINUM IN WATER WITH BUFFER:
(3.84 g CITRIC ACID AND 1.20 g NaOH IN 100 g WATER); pH=4.29

ALEX ALUMINUM IN WATER WITH BUFFER:
(2.40 g $NaH_2PO_4$ AND 2.84 g $NaHPO_4$ IN 100 g WATER); pH=6.57

ALEX ALUMINUM IN WATER WITH BUFFER:
($NaH_2PO_4$ + CITRIC ACID); pH=5.0

NON-TOXIC PERCUSSION PRIMERS AND METHODS OF PREPARING THE SAME

RELATED APPLICATION

This application is a continuation of application Ser. No. 12/029,084 filed Feb. 11, 2008, now U.S. Pat. No. 8,192,568, which in turn is a continuation-in-part of application Ser. No. 11/704,530 filed Feb. 9, 2007, now U.S. Pat. No. 8,202,377, each of which is hereby fully incorporated herein by reference.

FIELD OF THE INVENTION

The present invention relates to percussion primer compositions for explosive systems, and to methods of making the same.

BACKGROUND OF THE INVENTION

Due to the concern over the known toxicity of certain metal compounds such as lead, there has been an effort to replace percussion primers based on lead styphnate, with lead-free percussion primers.

The Department of Defense (DOD) and the Department of Energy (DOE) have made a significant effort to find replacements for metal based percussion primers. Furthermore, firing ranges and other locales of firearms usage have severely limited the use of percussion primers containing toxic metal compounds due to the potential health risks associated with the use of lead, barium and antimony.

Ignition devices rely on the sensitivity of the primary explosive that significantly limits available primary explosives. The most common lead styphnate alternative, diazodinitrophenol (DDNP or dinol), has been used for several decades relegated to training ammunition. DDNP-based primers suffer from poor reliability that may be attributed to low friction sensitivity, low flame temperature, and are hygroscopic.

Metastable interstitial composites (MIC) (also known as metastable nanoenergetic composites (MNC) or superthermites), including $Al/MoO_3$, $Al/WO_3$, Al/CuO and $Al/Bi_22O_3$, have been identified as potential substitutes for currently used lead styphnate. These materials have shown excellent performance characteristics, such as impact sensitivity and high temperature output. However, it has been found that these systems, despite their excellent performance characteristics, are difficult to process safely. The main difficulty is handling of dry nano-size powder mixtures due to their sensitivity to friction and electrostatic discharge (ESD). See U.S. Pat. No. 5,717,159 and U.S. Patent Publication No. 2006/0113014.

Health concerns may be further compounded by the use of barium and lead containing oxidizers. See, for example, U.S. Patent Publication No. 20050183805.

There remains a need in the art for an ignition formulation that is free of toxic metals, is non-corrosive, may be processed and handled safely, has sufficient sensitivity, and is more stable over a broad range of storage conditions.

SUMMARY OF THE INVENTION

In one aspect, the present invention relates to a method of making a percussion primer or igniter, the method including providing at least one water wet explosive, combining at least one fuel particle having a particle size of less than about 1500 nanometers with at least one water wet explosive to form a first mixture and combining at least one oxidizer.

In another aspect, the present invention relates to a method of making a percussion primer, the method including providing at least one water wet explosive, combining a plurality of fuel particles having a particle size range of about 0.1 nanometers to about 1500 nanometers with the at least one water wet-explosive to form a first mixture and combining at least one oxidizer.

In another aspect, the present invention relates to a method of making a percussion primer including providing at least one wet explosive, combining at least one fuel particle having a particle size of about 1500 nanometers or less with the at least one water wet explosive to form a first mixture and combining at least one oxidizer having an average particle size of about 1 micron to about 200 microns.

In another aspect, the present invention relates to a method of making a primer composition including providing at least one water wet explosive, combining a plurality of fuel particles having an average particle size of 1500 microns or less with at least one water wet explosive and combining an oxidizer.

In any of the above embodiments, the oxidizer may be combined with the explosive, or with the first mixture.

In another aspect, the present invention relates to a primer composition including at least one explosive, at least one fuel particle and a combination of at least one organic acid and at least one inorganic acid.

In another aspect, the present invention relates to a percussion primer premixture including at least one explosive, at least one fuel particle having a particle size of about 1500 nanometers or less and water in an amount of about 10 wt-% to about 50 wt-% of the premixture.

In another aspect, the present invention relates to a primer composition including a relatively insensitive secondary explosive that is a member selected from the group consisting of nitrocellulose, RDX, HMX, CL-20, TNT, styphnic acid and mixtures thereof and a reducing agent that is a member selected from the group consisting of nano-size fuel particles, an electron-donating organic particle and mixtures thereof.

In another aspect, the present invention relates to a slurry of particulate components in an aqueous media, the particulate components including three different particulate components, the particulate components being particulate explosive, uncoated fuel particles having a particle size of about 1500 nanometers or less, and oxidizer particles.

In another aspect, the present invention relates to a primer premixture including fuel particles having a particles size of about 1500 nanometers or less in a buffered aqueous media.

In another aspect, the present invention relates to a percussion primer including nano-size fuel particles in an amount of about 1 to about 13 percent based on the dry weight of the percussion primer.

In another aspect, the present invention relates to a primer-containing ordnance assembly including a housing, a secondary explosive disposed within the housing and a primary explosive disposed within the housing, and including at least one percussion primer according to any of the above embodiments.

These and other aspects of the invention are described in the following detailed description of the invention or in the claims.

DETAILED DESCRIPTION OF THE DRAWINGS

Figure 1A:
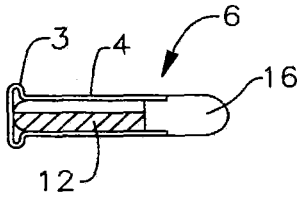
FIG. 1A is a longitudinal cross-section of a rimfire gun cartridge employing a percussion primer composition of one embodiment of the invention.

While this invention may be embodied in many different forms, there are described in detail herein specific preferred embodiments of the invention. This description is an exemplification of the principles of the invention and is not intended to limit the invention to the particular embodiments illustrated.

All published documents, including all U.S. patent documents, mentioned anywhere in this application are hereby expressly incorporated herein by reference in their entirety. Any copending patent applications, mentioned anywhere in this application are also hereby expressly incorporated herein by reference in their entirety.

In one aspect, the present invention relates to percussion primer compositions that include at least one energetic, at least one fuel particle having a particle size of about 1500 nanometers (nm) or less, suitably about 1000 nm or less and more suitably about 650 nm or less, and at least one oxidizer.

In some embodiments, the at least one fuel particle is non-coated.

Optionally, a buffer or mixture of buffers may be employed.

In some embodiments, a sensitizer for increasing the sensitivity of the primary explosive is added to the primer compositions.

The primer mixture according to one or more embodiments of the invention creates sufficient heat to allow for the use of moderately active metal oxides that are non-hygroscopic, non-toxic and non-corrosive. The primary energetic is suitably selected from energetics that are relatively insensitive to shock, friction and heat according to industry standards, making processing of these energetics more safe. Some of the relatively insensitive explosives that find utility herein for use as the primary explosive have been categorized generally as a secondary explosive due to their relative insensitivity.

Examples of suitable classes of energetics include, but are not limited to, nitrate esters, nitramines, nitroaromatics and mixtures thereof. The energetics suitable for use herein include both primary and secondary energetics in these classes.

Examples of suitable nitramines include, but are not limited to, CL-20, RDX, HMX and nitroguanidine.

RDX (royal demolition explosive), hexahydro-1,3,5-trinitro-1,3,5 triazine or 1,3,5-trinitro-1,3,5-triazacyclohexane, may also be referred to as cyclonite, hexagen, or cyclotrimethylenetrinitramine.

HMX (high melting explosive), octahydro-1,3,5,7-tetranitro-1,3,5,7-tetrazocine or 1,3,5,7-tetranitro-1,3,5,7 tetraazacyclooctane (HMX), may also be referred to as cyclotetramethylene-tetranitramine or octagen, among other names.

CL-20 is 2,4,6,8,10,12-hexanitrohexaazaisowurtzitane (HNIW) or 2,4,6,8,10,12-hexanitro-2,4,6,8,10,12-hexaazatetracyclo[5.5.0.0.sup.5,90.-sup.3,11]-dodecane.

Examples of suitable nitroaromatics include, but are not limited to, tetryl (2,4,6-trinitrophenyl-methylnitramine), TNT (2,4,6-trinitrotoluene), DDNP (diazodinitrophenol or 4,6-dinitrobenzene-2-diazo-1-oxide) and mixtures thereof.

Examples of suitable nitrate esters include, but are not limited to, PETN (pentaerythritoltetranitrate) and nitrocellulose.

Explosives may be categorized into primary explosives and secondary explosives depending on their relative sensitivity, with the secondary explosives being less sensitive than the primary explosives.

Examples of primary explosives include, but are not limited to, lead styphnate, metal azides, diazodinitrophenol, potassium, etc. As noted above, such primary explosives are undesirable for use herein.

Suitably, the explosive employed in the percussion primers disclosed herein includes a secondary explosive. Preferred secondary explosives according to the invention include, but are not limited to, nitrocellulose, RDX, HMX, CL-20, TNT, styphnic acid and mixtures thereof.

The above lists are intended for illustrative purposes only, and not as a limitation on the scope of the present invention.

In some embodiments, nitrocellulose is employed. Nitrocellulose, particularly nitrocellulose having a high percentage of nitrogen, for example, greater than about 10 wt-% nitrogen, and having a high surface area, has been found to increase sensitivity. In primers wherein the composition includes nitrocellulose, flame temperatures exceeding those of lead styphnate have been created. In some embodiments, the nitrocellulose has a nitrogen content of about 12.5-13.6% by weight and a particle size of 80-120 mesh.

The primary explosive can be of varied particulate size. For example, particle size may range from approximately 0.1 micron to about 100 microns. Blending of more than one size and type can be effectively used to adjust formulation sensitivity.

The primary explosive is suitably employed in amounts of about 5% to about 40% by weight. This range may be varied depending on the primary explosive employed.

Examples of suitable fuel particles for use herein include, but are not limited to, aluminum, boron, molybdenum, silicon, titanium, tungsten, magnesium, melamine, zirconium, calcium silicide, and mixtures thereof.

Figure 8:
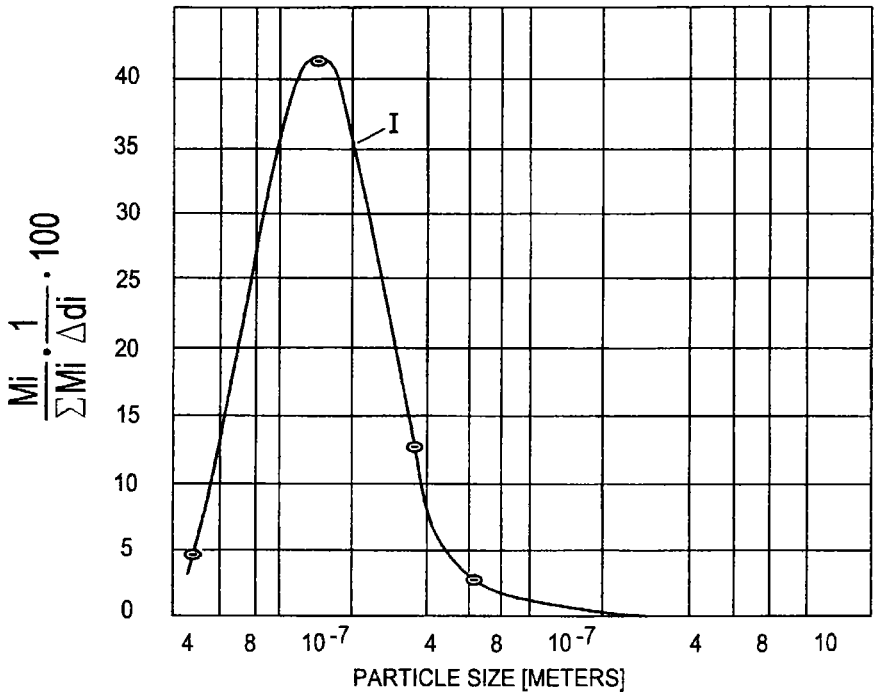
FIG. 8 is a graph illustrating a fuel particle size distribution.

The fuel particle may have a particle size of 1500 nanometers (nm) or less, more suitably about 1000 nm or less, and most suitably about 650 nm or less. In some embodiments a plurality of particles having a size distribution is employed. The distribution of the fuel particles may range from about 0.1 to about 1500 nm, suitably about 0.1 to about 1000 nm and most suitably about 0.1 to about 650 nm. The distribution may be unimodal or multimodal. FIG. 8 provides one example of a unimodal particle size distribution for aluminum fuel particles. The surface area of these particles is about 12 to 18 m.sup.2/g.

Average particle sizes for a distribution mode may be about 1500 nm or less, suitably about 1000 nm or less, even more suitably about 650 or less, and most suitably about 500 nm or less. In some embodiments, the average fuel particle is about 100 to about 500 nm, more suitably about 100 to about 350 nm.

In one particular embodiment, the fuel particles have an average fuel particle size of about 100 to about 200 nm.

In another embodiment, the fuel particles have an average particle size of about 250 nm to about 350 nm.

As one specific example, aluminum fuel particles having an average particle size of about 100 nm to about 200 nm may be selected.

As another specific example, titanium fuel particles having an average particle size of about 250 to about 350 nm may be selected.

Although the present invention is not limited to this specific size of fuel particle, keeping the average size fuel particle above about 0.05 microns or 50 nanometers, can significantly improve the safety of processing due to the naturally occurring surface oxides and thicker oxide layer that exist on larger fuel particles. Smaller fuel particles may exhibit higher impact (friction) and shock sensitivities.

Very small fuel particles, such as those between about 20 nm and 50 nm, can be unsafe to handle. In the presence of oxygen they are prone to autoignition and are thus typically kept organic solvent wet or coated such as with polytetrafluoroethylene or an organic acid such as oleic acid.

Thus, it is preferred that the fuel particles have an average particle size of at least about 100 nm or more.

Suitably, the fuel particles according to one or more embodiments of the invention have natural oxides on the surface thereof. Surface oxides reduce the sensitivity of the fuel particle, and reduce the need to provide any additional protective coating such as a fluoropolymer coating, e.g. polytetrafluoroethylene (PTFE), an organic acid coating or a phosphate based coating to reduce sensitivity and facilitate safe processing of the composition, or if non-coated, reduce the need to employ a solvent other than water. See, for example, U.S. Pat. No. 5,717,159 or U.S. Patent Application Publication No. US 2006/0113014 A1, both of which are incorporated by reference herein in their entirety. Natural oxides are not considered "coatings" for purposes of this application.

Natural surface oxides on the surface of these fuel particles improves the stability of the particles which consequently increases the margin of safety for processing and handling. Furthermore, a lower surface area may also decrease hazards while handling the small fuel particles as risk of an electrostatic discharge initiation of the small fuel particles decreases as the surface area decreases.

Thus, coatings for the protection of the fuel particle and/or the use of solvents, may be eliminated due to the increased surface oxides on nano-sized fuel particles.

One specific example of a fuel particle that may be employed herein is Alex® nano-aluminum powder having an average particle size of about 100 (about 0.1 micron) to about 200 nanometers (0.2 microns), for example, an average particles size of about 130 nm, available from Argonide Nanomaterials in Pittsburgh, Pa.

Suitably, the nano-size fuel particles are employed in the primer composition, on a dry weight basis, in an amount of about 1% to about 20% by weight, more suitably about 1% to about 15% by weight of the dry primer composition. It is desirable to have at least about 1% by weight, more suitably at least about 2% by weight and most suitably at least about 5% by weight of the nano-size fuel particles, based on the dry weight of the primer composition.

Keeping the amount of the nano-size fuel particles employed in the primer composition low is beneficial in part because it reduces cost and also because it has been discovered that if too many nano-size fuel particles are employed excessive oxygen is taken out of the system, which can result in muzzle flash. Consequently, in particular embodiments the nano-size fuel particles are employed in the primer composition, on a dry weight basis, in an amount of not more than about 13% by weight of the dry primer composition, even more suitably about 1% to about 12% by weight of the dry primer composition, even more suitably about 1% to about 10% by weight of the dry primer composition and most suitably about 1% to about 8% by weight of the dry primer composition. In some preferred embodiments, about 6% by weight of the nano-size fuel particles are used based on the weight of the dry primer composition.

Buffers can be optionally added to the primer compositions to decrease the likelihood of hydrolysis of the fuel particles, which is dependent on both temperature and pH. While single acid buffers may be employed, the present inventors have found that a dual acid buffer system significantly increases the temperature stability of the percussion primer composition. Of course, more than two buffers may be employed as well. For example, it has been found that while a single acid buffer system can increase the temperature at which hydrolysis of the fuel particle occurs to about 120-140° F. (about 49° C.-60° C.), these temperatures are not sufficient for standard processing of percussion primers that includes oven drying. Therefore, higher hydrolysis onset temperatures are desirable for safe oven drying of the percussion primer compositions.

While any buffer may be suitably employed herein, it has been found that some buffers are more effective than others for reducing the temperature of onset of hydrolysis. In one embodiment, an inorganic acid, for example, phosphoric acid or salt thereof, i.e. phosphate, is employed. In another embodiment, a combination of an organic acid or salt thereof and an inorganic acid or salt thereof is employed, for example, an organic acid, such as citric acid, and a phosphate salt are employed. More specifically, in some embodiments, a combination of citrate and phosphate are employed. In weakly basic conditions, the dibasic phosphate ion ($HPO_4^{2-}$) and the tribasic citrate ion ($C_6H_6O_7^{2-}$) are prevalent. In weakly acid conditions, the monobasic phosphate ion ($H_2PO_4^-$) and the dibasic citrate ion ($C_6H_6O_7^{2-}$) are most prevalent.

Furthermore, the stability of explosives to both moisture and temperature is desirable for safe handling of firearms. For example, small cartridges are subject to ambient conditions including temperature fluctuations and moisture, and propellants contain small amounts of moisture and volatiles. It is desirable that these loaded rounds are stable for decades, be stable for decades over a wide range of environmental conditions of fluctuating moisture and temperatures.

It has been discovered that primer compositions according to one or more embodiments of the invention can be safely stored water wet (e.g. 25% water) for long periods without any measurable affect on the primer sensitivity or ignition capability. In some embodiments, the primer compositions may be safely stored for at least about 5 weeks without any measurable affect on primer sensitivity or ignition capability.

The aluminum contained in the percussion primer compositions according to one or more embodiments of the invention exhibit no exotherms during simulated bulk autoignition tests (SBAT) at temperatures greater than about 200° F. (about 93° C.), and even greater than about 225° F. (about 107° C.) when tested as a slurry in water.

In some embodiments, additional fuels may be added. For example, in one embodiment, an additional aluminum fuel having a particle size of about 80 mesh to about 120 mesh is employed. Such particles have a different distribution mode and are not to be taken into account when determining average particle size of the <1500 nm particles.

A sensitizer may be added to the percussion primer compositions according to one or more embodiments of the invention. As the particle size of the nano-size fuel particles increases, sensitivity decreases. Thus, a sensitizer may be beneficial. Sensitizers may be employed in amounts of 0% to about 20%, suitably 0% to about 15% by weight and more suitably 0% to about 10% by weight of the composition. One example of a suitable sensitizer includes, but is not limited to, tetracene.

The sensitizer may be employed in combination with a friction generator. Friction generators are useful in amounts of about 0% to about 25% by weight of the primer composition. One example of a suitable friction generator includes, but is not limited to, glass powder.

Tetracene is suitably employed as a sensitizing explosive while glass powder is employed as a friction generator.

An oxidizer is suitably employed in the primer compositions according to one or more embodiments of the invention. Oxidizers may be employed in amounts of about 20% to about 70% by weight of the primer composition. Suitably, the oxidizers employed herein are moderately active metal oxides, and are non-hygroscopic and are not considered toxic. Examples of oxidizers include, but are not limited to, bismuth oxide, bismuth subnitrate, bismuth tetroxide, bismuth sulfide, zinc peroxide, tin oxide, manganese dioxide, molybdenum trioxide, and combinations thereof.

The oxidizer is not limited to any particular particle size and nano-size oxidizer particles can be employed herein. However, it is more desirable that the oxidizer has an average particle size that is about 1 micron to about 200 microns, more suitably about 10 microns to about 200 microns, and most suitably about 100 microns to about 200 microns. In one embodiment, the oxidizer has an average particle size of about 150 to about 200 microns, for example, about 175 microns.

In a particular embodiment, the oxidizer employed is bismuth trioxide having an average particle size of about 100 to about 200 microns, for example, about 177 microns, is employed.

While nano-size particulate oxidizers can be employed, they are not as desirable for safety purposes as the smaller particles are more sensitive to water and water vapor. One example of a nano-size particulate oxidizer is nano-size bismuth trioxide having an average particle size of less than 1 micron, for example, 0.9 microns or 90 nanometers.

It is surmised that the nano-size fuel particles disclosed herein, act as a reducing agent (i.e. donate electrons) for the explosive. It is further surmised that organic reducing agents may find utility herein. For example, melamine or BHT.

Other conventional primer additives such as binders may be employed in the primer compositions herein as is known in the art. Both natural and synthetic binders find utility herein. Examples of suitable binders include, but are not limited to, natural and synthetic gums including xanthan, Arabic, tragacanth, guar, karaya, and synthetic polymeric binders such as hydroxypropylcellulose and polypropylene oxide, as well as mixtures thereof. See also U.S. Patent Publication No. 2006/0219341 A1, the entire content of which is incorporated by reference herein. Binders may be added in amounts of about 0.1 wt % to about 5 wt-% of the composition, and more suitably about 0.1 wt % to about 1 wt % of the composition.

Other optional ingredients as are known in the art may also be employed in the compositions according to one or more embodiments of the invention. For example, inert fillers, diluents, other binders, low out put explosives, etc., may be optionally added.

The above lists and ranges are intended for illustrative purposes only, and are not intended as a limitation on the scope of the present invention.

In one preferred embodiment, a relatively insensitive explosive, such as nitrocellulose, is employed in combination with an aluminum particulate fuel having an average particle size of about 1500 nm or less, suitably about 1000 nm or less, more suitably about 650 nm or less, most suitably about 350 nm or less, for example, about 100 nm to about 200 nm average particle size. A preferred oxidizer is bismuth trioxide having an average particle size between about 1 micron and 200 microns, for example about 100 microns to about 200 microns is employed. An inorganic buffer such as phosphate is employed, or a dual buffer system including an inorganic and an organic acid or salt thereof is employed, for example, phosphate and citric acid.

The primer compositions according to one or more embodiments of the invention may be processed using simple water processing techniques. The present invention allows the use of larger fuel particles which are safer for handling while maintaining the sensitivity of the assembled primer. It is surmised that this may be attributed to the use of larger fuel particles and/or the dual buffer system. The steps of milling and sieving employed for MIC-MNC formulations may also be eliminated. For at least these reasons, processing of the primer compositions according to the invention is safer.

The method of making the primer compositions according to one or more embodiments of the invention generally includes mixing the primary explosive wet with at least one fuel particle having a particle size of less than about 1500 nm to form a first mixture. An oxidizer may be added to either the wet explosive, or to the first mixture. The oxidizer may be optionally dry blended with at least one binder to form a second dry mixture, and the second mixture then added to the first mixture and mixing until homogeneous to form a final mixture.

As used herein, the term water-wet, shall refer to a water content of between about 10 wt-% and about 50 wt-%, more suitably about 15% to about 40% and even more suitably about 20% to about 30%. In one embodiment, about 25% water or more is employed, for example, 28% is employed.

It is desirable to employ water without any additional solvents, although the invention is not limited as such.

If a sensitizer is added, the sensitizer may be added either to the water wet primary explosive, or to the primary explosive/fuel particle wet blend. The sensitizer may optionally further include a friction generator such as glass powder.

At least one buffer, or combination of two or more buffers, may be added to the process to keep the system acidic and to prevent significant hydrogen evolution and further oxides from forming. In embodiments wherein the metal based fuel is subject to hydrolysis, such as with aluminum, the addition of a mildly acidic buffer having a pH in the range of about 4-8, suitably 4-7, can help to prevent such hydrolysis. While at a pH of 8, hydrolysis is delayed, by lowering the pH, hydrolysis can be effectively stopped, thus, a pH range of 4-7 is preferable. The buffer solution is suitably added as increased moisture to the primary explosive prior to addition of non-coated nano-size fuel particle. Furthermore, the nano-size fuel particle may be preimmersed in the buffer solution to further increase handling safety.

In one embodiment, the pH of the water wet explosive is adjusted by adding at least one buffer or combination thereof to the water wet explosive.

Alternatively, in another embodiment, fuel particles are added to a buffered aqueous media. This then may be combined with the other ingredients.

Although several mechanisms can be employed depending on the primary explosive, it is clear that simple water mixing methods may be used to assemble the percussion primer using standard industry practices and such assembly can be accomplished safely without stability issues. The use of such water processing techniques is beneficial as previous primer compositions such as MIC/MNC primer compositions have limited stability in water.

The nano-size fuel particles and the explosive can be water-mixed according to one or more embodiments of the invention, maintaining conventional mix methods and associated safety practices.

The processing sequence employed in the invention is unlike that of U.S. Patent Publication No. 2006/0113014 where nano-size fuel particles are combined with nano-size oxidizer particles prior to the optional addition of any explosive component. The sequence used U.S. Patent Publication No. 2006/0113014 is believed to be employed to ensure that thorough mixing of the nano-size particles is accomplished without agglomeration. The smaller particles, the more the tendency that such particles clump together. Furthermore, if these smaller particles are mixed in the presence of an explosive, before they were fully disbursed, the mixing process might result in the explosive pre-igniting. Still further, even without the presence of an explosive component, the oxidizer and fuel particles are not mixed in any of the examples unless an organic solvent has been employed, either to precoat the fuel particles or as a vehicle when the particles are mixed, and then the additional step of solvent removal must be performed.

The combination of ingredients employed in the percussion primer herein is beneficial because it allows for a simplified processing sequence in which the nano-fuel particles and oxidizer do not need to be premixed. The larger oxidizer particles employed, along with the use of a relatively insensitive secondary explosive, therefore allows a process that is simpler, has an improved safety margin and at the same time reduces material and handling cost. Thus the invention provides a commercially efficacious percussion primer, a result that has heretofore not been achieved.

Broadly, primary oxidizer-fuel formulations according to one or more embodiments of the invention, when blended with fuels, sensitizers and binders, can be substituted in applications where traditional lead styphnate and diazodinitrophenol (DDNP) primers and igniter formulations are employed. The heat output of the system is sufficient to utilize non-toxic metal oxidizers of higher activation energy typically employed but under utilized in lower flame temperature DDNP based formulations.

Additional benefits of the present invention include improved stability, increased ignition capability, improved ignition reliability, lower final mix cost, and increased safety due to the elimination of lead styphnate production and handling.

The present invention finds utility in any igniter or percussion primer application where lead styphnate is currently employed. For example, the percussion primer according to the present invention may be employed for small caliber and medium caliber cartridges, as well as industrial powerloads.

The following tables provide various compositions and concentration ranges for a variety of different cartridges. Such compositions and concentration ranges are for illustrative purposes only, and are not intended as a limitation on the scope of the present invention.

For purposes of the following tables, the nitrocellulose is 30-100 mesh and 12.5-13.6 wt-% nitrogen. The nano-aluminum is sold under the tradename of Alex® and has an average particles size of 0.1 microns. The additional aluminum fuel is 80-120 mesh.

TABLE 1

Illustrative percussion primer compositions for pistol/small rifle

| Pistol/Small Rifle | Range wt-% | Preferred wt-% |
|---|---|---|
| Nitrocellulose | 10-30 | 20 |
| Nano-Aluminum | 4-12- | 6 |
| Bismuth trioxide | 50-70 | 64.5 |
| Tetracene | 0-6 | 5 |
| Binder | 0.3-0.8 | 0.4 |
| Buffer/stabilizer | 0.1-0.5 | 0.1 |

TABLE 2

Illustrative percussion primer compositions for large rifle

| Large Rifle | Range wt-% | Preferred wt-% |
|---|---|---|
| Nitrocellulose | 6-10 | 7.5 |
| Single-base ground propellant | 10-30 | 22.5 |
| Nano-Aluminum | 4-12 | 6 |
| Aluminum, 80-120 mesh | 2-6 | 4 |
| Bismuth trioxide | 40-60 | 50 |
| Tetracene | 0-6 | 5 |
| Binder | 0.3-0.8 | 0.4 |
| Buffer/stabilizer | 0.1-0.5 | 0.1 |

TABLE 3

Illustrative percussion primer compositions for industrial/commercial power load rimfire.

| Power load rimfire | Range wt-% | Preferred wt-% |
|---|---|---|
| Nitrocellulose | 14-22 | 18 |
| Nano-Aluminum | 4-15 | 6 |
| Bismuth trioxide | 30-43 | 38 |
| DDNP | 12-18 | 14.5 |
| Tetracene | 0-7 | 5 |
| Binder | 1-2 | 1 |
| Glass | 12-18 | 14 |

TABLE 4

Illustrative percussion primer compositions for industrial commercial power load rimfire

| Rimfire | Range wt-% | Preferred wt % |
|---|---|---|
| Nitrocellulose | 14-25 | 19 |
| Nano-Aluminum | 4-15 | 6 |
| Bismuth trioxide | 40-70 | 55 |
| Tetracene | 0-10 | 5 |
| Binder | 1-2 | 1 |
| Glass | 0-20 | 10 |

TABLE 5

Illustrative percussion primer compositions for industrial/commercial rimfire

| Rimfire | Range wt-% | Preferred wt-% |
|---|---|---|
| Nitrocellulose | 12-20 | 15 |
| Nano-Aluminum | 4-12 | 6 |
| Bismuth trioxide | 50-72 | 59 |
| Tetracene | 4-10 | 5 |
| Binder | 1-2 | 1 |
| Glass | 0-25 | 10 |

TABLE 6

Illustrative percussion primer compositions for industrial/commercial shotshell

| Shotshell | Range wt-% | Preferred wt-% |
|---|---|---|
| Nitrocellulose | 14-22 | 18 |
| Single-base ground propellant | 8-16 | 9 |
| Nano-Aluminum | 4-10 | 6 |
| Aluminum, 80-120 mesh | 2-5 | 3 |
| Bismuth trioxide | 45-65 | 46 |
| Tetracene | 4-10 | 5 |
| Binder | 1-2 | 1 |
| Glass | 0-25 | 10 |

In one embodiment, the percussion primer is used in a centerfire gun cartridge or in a rimfire gun cartridge. In small arms using the rimfire gun cartridge, a firing pin strikes a rim of a casing of the gun cartridge. In contrast, the firing pin of small arms using the centerfire gun cartridge strikes a metal cup in the center of the cartridge casing containing the percussion primer. Gun cartridges and cartridge casings are known in the art and, therefore, are not discussed in detail herein. The force or impact of the firing pin may produce a percussive event that is sufficient to detonate the percussion primer in the rimfire gun cartridge or in the centerfire gun cartridge, causing the secondary explosive composition to ignite.

Figure 1B:
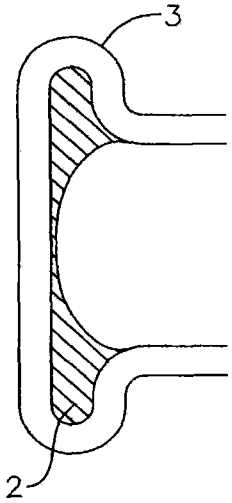
FIG. 1B is an enlarged view of the anterior portion of the rimfire gun cartridge shown in FIG. 1A.

Turning now to the figures, FIG. 1A is a longitudinal cross-section of a rimfire gun cartridge shown generally at 6. Cartridge 6 includes a housing 4. Percussion primer 2 may be substantially evenly distributed around an interior volume defined by a rim portion 3 of casing 4 of the cartridge 6 as shown in FIG. 1B which is an enlarged view of an anterior portion of the rimfire gun cartridge 6 shown in FIG. 1A.

Figure 2A:
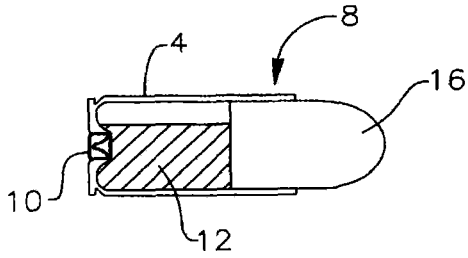
FIG. 2A is a longitudinal cross-section of a centerfire gun cartridge employing a percussion primer composition of one embodiment of the invention.
Figure 2B:
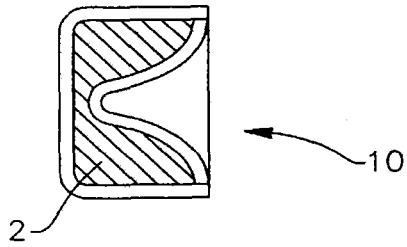
FIG. 2B is an enlarged view a portion of the centerfire gun cartridge of FIG. 2A that houses the percussion primer.

FIG. 2A is a longitudinal cross-sectional view of a centerfire gun cartridge shown generally at 8. In this embodiment, the percussion primer 2 may be positioned in an aperture 10 in the casing 4. FIG. 2B is an enlarged view of aperture 10 in FIG. 2A more clearly showing primer 2 in aperture 10.

The propellant composition 12 may be positioned substantially adjacent to the percussion primer 2 in the rimfire gun cartridge 6 or in the centerfire gun cartridge 8. When ignited or combusted, the percussion primer 2 may produce sufficient heat and condensing of hot particles to ignite the propellant composition 12 to propel projectile 16 from the barrel of the firearm or larger caliber ordnance (such as, without limitation, handgun, rifle, automatic rifle, machine gun, any small and medium caliber cartridge, automatic cannon, etc.) in which the cartridge 6 or 8 is disposed. The combustion products of the percussion primer 2 may be environmentally friendly, noncorrosive, and nonabrasive.

Figure 3:
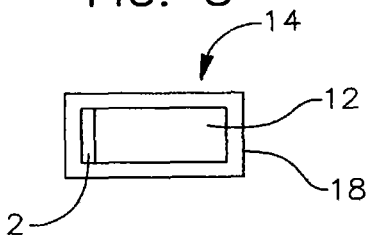
FIG. 3 is a schematic illustration of exemplary ordnance in which a percussion primer of one embodiment of the invention is used.

As previously mentioned, the percussion primer 2 may also be used in larger ordnance, such as (without limitation) grenades, mortars, or detcord initiators, or to initiate mortar rounds, rocket motors, or other systems including a secondary explosive, alone or in combination with a propellant, all of the foregoing assemblies being encompassed by the term "primer-containing ordnance assembly," for the sake of convenience. In the ordnance, motor or system 14, the percussion primer 2 may be positioned substantially adjacent to a secondary explosive composition 12 in a housing 18, as shown in FIG. 3. For purposes of simplicity, as used herein, the term "ordnance" shall be employed to refer to any of the above-mentioned cartridges, grenades, mortars, initiators, rocket motors, or any other systems in which the percussion primer disclosed herein may be employed.

In any of the cartridge assemblies discussed above, the wet primer composition is mixed in a standard mixer assembly such as a Hobart or planetary type mixer. Primer cups are charged with the wet primer mixture, an anvil placed over the top, and the assembly is then placed in an oven at a temperature of about 150° F. for 1 to 2 hours or until dry.

The following non-limiting examples further illustrate the present invention but are in no way intended to limit the scope thereof.

EXAMPLES

Example 1

Nitrocellulose 10-40 wt %

Aluminum 5-20 wt % (average particle size 0.1 micron)

Aluminum 0-15 wt % (standard mesh aluminum as common to primer mixes)

Tetracene 0-10 wt %

Bismuth Trioxide 20-75 wt %

Gum Tragacanth 0.1-1.0 wt %

The nitrocellulose in an amount of 30 grams was placed water-wet in a mixing apparatus. Water-wet tetracene, 5 g, was added to the mixture and further mixed until the tetracene was not visible. Nano-aluminum powder, 10 g, was added to the water-wet nitrocellulose/tetracene blend and mixed until homogeneous. Bismuth trioxide, 54 g, was dry blended with 1 g of gum tragacanth and the resultant dry blend was added to the wet explosive mixture, and the resultant blend was then mixed until homogeneous. The final mixture was removed and stored cool in conductive containers.

Example 2

Various buffer systems were tested using the simulated bulk autoignition temperature (SBAT) test. Simple acidic buffers provided some protection of nano-aluminum particles. However, specific dual buffer systems exhibited significantly higher temperatures for the onset of hydrolysis. The sodium hydrogen phosphate and citric acid dual buffer system exhibited significantly higher temperatures before hydrolysis occurred. This is well above stability requirements for current primer mix and propellants. As seen in the SBAT charts, even at pH=8.0, onset with this system is delayed to 222° F. (105.6° C.). At pH=5.0 onset is effectively stopped.

TABLE 7

ALEX ® Aluminum in Water

| Buffer | pH | SBAT onset Temperature ° F. (° C.) |
|---|---|---|
| 1) Distilled water only | | 118° F. (47.8° C.) |
| 2) Sodium acetate/acetic acid | 5.0 | 139° F. (59.4° C.) |
| 3) Potassium phosphate/borax | 6.6 | 137° F. (58.3° C.) |
| 4) Potassium phosphate/borax | 8.0 | 150° F. (65.6° C.) |
| 5) Sodium hydroxide/acetic acid/phosphoric acid/boric acid | 5.02 | 131° F. (55° C.) |
| 6) Sodium hydroxide/acetic acid/phosphoric acid/boric acid | 6.6 | 125° F. (51.7° C.) |
| 7) Sodium hydroxide/acetic acid/phosphoric acid/boric acid | 7.96 | 121° F. (49.4° C.) |
| 8) Sodium hydrogen phosphate/citric acid | 5.0 | No exotherm/ water evaporation endotherm only |
| 9) Sodium hydrogen phosphate/citric acid | 6.6 | 239° F. (115° C.) |

TABLE 7-continued

| ALEX ® Aluminum in Water | | |
|---|---|---|
| Buffer | pH | SBAT onset Temperature ° F. (° C.) |
| 10) Sodium hydrogen phosphate/citric acid | 8.0 | 222° F. (105.6° C.) |
| 11) Citric acid/NaOH (3/84 g/1.20 g in 100 g $H_2O$) | 4.29 | 140° F. (60° C.) |
| 12) Citric acid/NaOH (3.84 g/2.00 g in 100 g $H_2O$) | 5.43 | 100° F. (37.8° C.) |
| 13) Sodium hydrogen phosphate (2.40 g/2.84 g in 100 g $H_2O$) | 6.57 | 129° F. (53.9° C.) |

As can be seen from Table 7, the combination of sodium hydrogen phosphate and citric acid significantly increases the temperature of onset of hydrolysis at a pH of 8.0 to 222° F. (105.6° C.) (see no. 10 above). At a pH of 5.0, hydrolysis is effectively stopped. See no. 8 in table 7.

Figure 4:
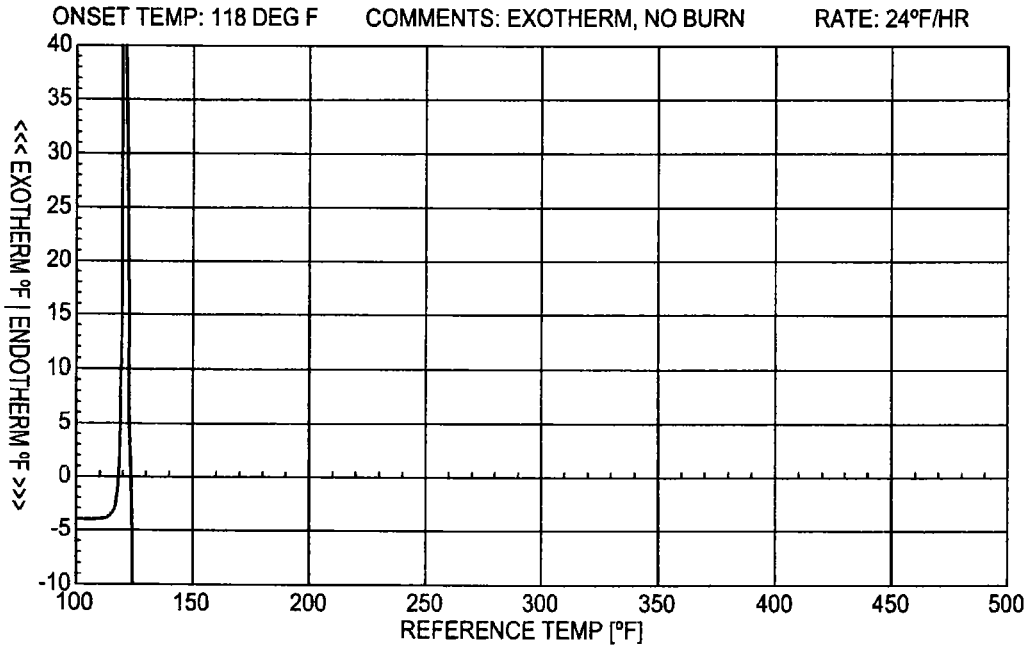
FIG. 4 is a simulated bulk autoignition temperature (SBAT) graph.

FIG. 4 is an SBAT graph illustrating the temperature at which hydrolysis begins when Alex® aluminum particles are mixed in water with no buffer. The hydrolysis onset temperature is 118° F. (47.8° C.). See no. 1 in table 7.

Figure 5:
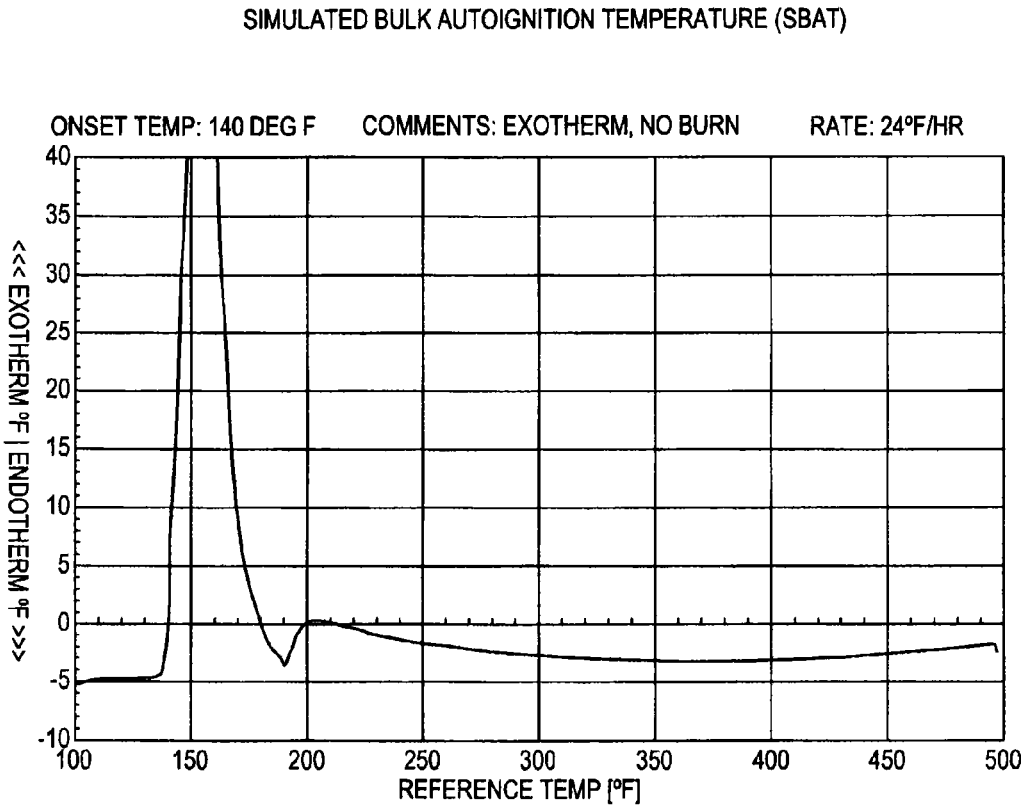
FIG. 5 is an SBAT graph.

FIG. 5 is an SBAT graph illustrating the temperature at which hydrolysis begins using only a single buffer which is citrate. The hydrolysis onset temperature is 140° F. (60° C.). See no. 11 in table 7.

Figure 6:
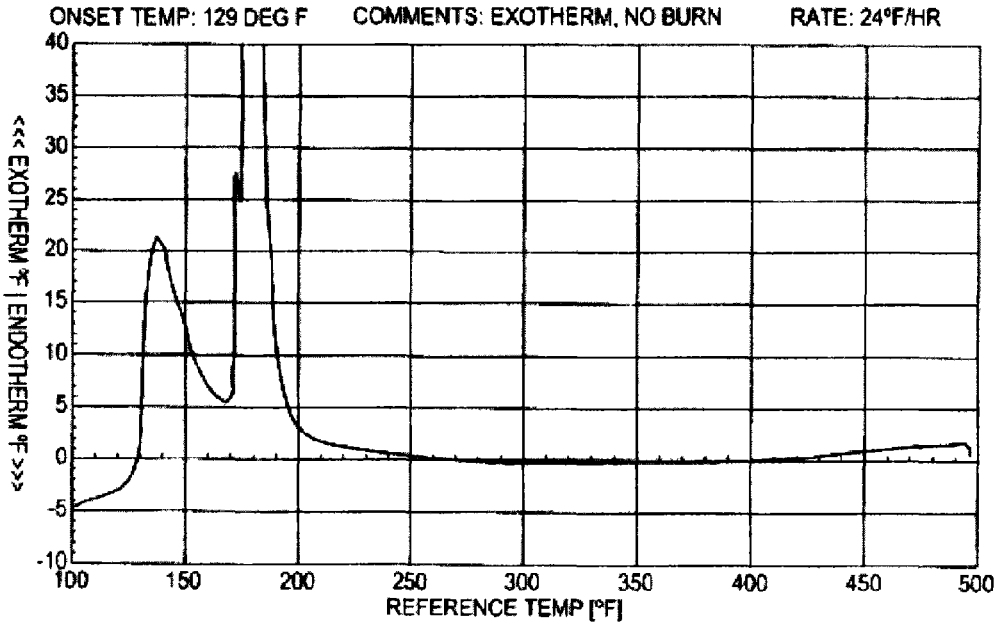
FIG. 6 is an SBAT graph.

FIG. 6 is an SBAT graph illustrating the temperature at which hydrolysis begins using only a single buffer which is a phosphate buffer. The hydrolysis onset temperature is 129° F. (53.9° C.).

Figure 7:
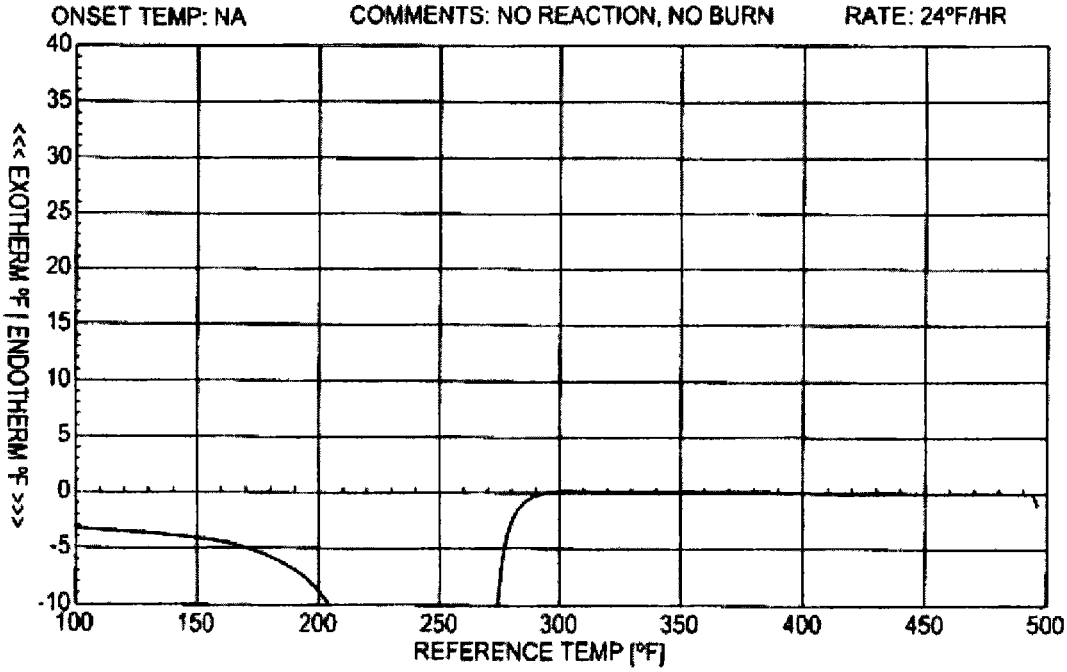
FIG. 7 is an SBAT graph.

FIG. 7 is an SBAT graph illustrating the temperature at which hydrolysis begins using a dual citrate/phosphate buffer system. Hydrolysis has been effectively stopped at a pH of 5.0 even at temperatures of well over 200° F. (about 93° C.).

As previously discussed, the present invention finds utility in any application where lead styphnate based igniters or percussion primers are employed. Such applications typically include an igniter or percussion primer, a secondary explosive, and for some applications, a propellant.

As previously mentioned, other applications include, but are not limited to, igniters for grenades, mortars, detcord initiators, mortar rounds, detonators such as for rocket motors and mortar rounds, or other systems that include a primer or igniter, a secondary explosive system, alone or in combination with a propellant, or gas generating system such as air bag deployment and jet seat ejectors.

The above disclosure is intended to be illustrative and not exhaustive. This description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

The invention claimed is:

1. A primer composition comprising:

an explosive consisting essentially of a nitrate ester chosen from pentaerythritol tetranitrate ("PETN"), nitrocellulose, and mixtures thereof and optionally a sensitizer;

a plurality of fuel particles having an average particle size of about 100 nm to about 1500 nm; and an oxidizer;

wherein the primer composition is essentially devoid of other explosives except for the optional sensitizer and/or a propellant.

2. The primer composition of claim 1, wherein said nitrate ester in an amount of about 5 wt-% to about 40 wt-% of the primer composition.

3. The primer composition of claim 1, wherein said nitrate ester comprises nitrocellulose.

4. The primer composition of claim 3, wherein said nitrocellulose in an amount of about 5 wt-% to about 40 wt-% of the primer composition.

5. The primer composition of claim 4, wherein said nitrocellulose in an amount of about 5 wt-% to about 20 wt-% of the primer composition.

6. The primer composition of claim 4, further comprising a sensitizer in an amount greater than 0 wt-% to about 20 wt-% of the primer composition.

7. The primer composition of claim 4, wherein said plurality of fuel particles are chosen from aluminum, boron, molybdenum, silicon, titanium, tungsten, magnesium, melamine, zirconium, calcium silicide, and mixtures thereof.

8. The primer composition of claim 7, wherein said oxidizer is chosen from bismuth trioxide, bismuth subnitrate, bismuth tetroxide, bismuth sulfide, zinc peroxide, tin oxide, manganese dioxide, molybdenum trioxide, potassium nitrate, and combinations thereof.

9. The primer composition of claim 8, wherein said plurality of fuel particles comprises aluminum and said oxidizer comprises bismuth trioxide.

10. The primer composition of claim 1, wherein said plurality of fuel particles are chosen from aluminum, boron, molybdenum, silicon, titanium, tungsten, magnesium, melamine, zirconium, calcium silicide, and mixtures thereof.

11. The primer composition of claim 10, wherein said oxidizer is chosen from bismuth trioxide, bismuth subnitrate, bismuth tetroxide, bismuth sulfide, zinc peroxide, tin oxide, manganese dioxide, molybdenum trioxide, potassium nitrate, and combinations thereof.

12. The primer composition of claim 1, wherein said oxidizer is chosen from bismuth trioxide, bismuth subnitrate, bismuth tetroxide, bismuth sulfide, zinc peroxide, tin oxide, manganese dioxide, molybdenum trioxide, potassium nitrate, and combinations thereof.

13. The primer composition of claim 1, further comprising at least one buffer.

14. The primer composition of claim 1, further comprising a friction generator.

15. The primer composition of claim 1, further comprising a single-base ground propellant.

16. The primer composition of claim 1, wherein the plurality of fuel particles have an average particle size of about 200 nm to about 1000 nm.

17. A primer composition comprising:

a primary explosive consisting essentially of nitrocellulose in an amount of about 5 wt-% to about 40 wt-% of the primer composition and optionally a sensitizer;

a plurality of fuel particles in an amount of about 1 wt-% to about 20 wt-% of the primer composition, said plurality of fuel particles having an average particle size of about 100 nm to about 1500 nm; and an oxidizer in an amount of about 20 wt-% to about 70 wt-% of the primer composition;

wherein the primer composition is essentially devoid of other explosives except for the optional sensitizer and/or a propellant.

18. The primer composition of claim 17, further comprising a sensitizer in an amount greater than 0 wt-% to about 20 wt-% of the primer composition.

19. The primer composition of claim 18, wherein said sensitizer comprises tetracene.

20. The primer composition of claim 17, wherein said plurality of fuel particles are chosen from aluminum, boron, molybdenum, silicon, titanium, tungsten, magnesium, melamine, zirconium, calcium silicide, and mixtures thereof.

21. The primer composition of claim 20, wherein said oxidizer is chosen from bismuth trioxide, bismuth subnitrate, bismuth tetroxide, bismuth sulfide, zinc peroxide, tin oxide, manganese dioxide, molybdenum trioxide, potassium nitrate, and combinations thereof.

22. The primer composition of claim 21, wherein said plurality of fuel particles comprises aluminum and said oxidizer comprises bismuth trioxide.

23. The primer composition of claim 17, wherein said oxidizer is chosen from bismuth trioxide, bismuth subnitrate, bismuth tetroxide, bismuth sulfide, zinc peroxide, tin oxide, manganese dioxide, molybdenum trioxide, potassium nitrate, and combinations thereof.

24. The primer composition of claim 17, further comprising at least one buffer.

25. The primer composition of claim 17, further comprising a single-base ground propellant.

26. The primer composition of claim 17, wherein the plurality of fuel particles have an average particle size of about 200 nm to about 1000 nm.

27. A primer composition comprising:

an explosive consisting essentially of at least one moderately insensitive explosive in an amount of about 5 wt-% to about 40 wt-% of the primer composition and optionally a sensitizer, the at least one moderately insensitive explosive chosen from nitrocellulose, pentaerythritol tetranitrate ("PETN"), 2,4,6,8,10,12-hexanitro-2,4,6,8,10,12-hexaazatetracyclo[5.5.0.0.$^{5,9}$0$^{3,11}$]-dodecane ("CL-20"), cyclo-1,3,5-trimethylene-2,4,6-trinitramine ("RDX"), cyclotetramethylene tetranitramine ("HMX"), 2,4,6-trinitrotoluene ("TNT"), nitroguanidine, styphnic acid, potassium dinitrobenzofuroxan ("KDNBF"), and mixtures thereof;

a plurality of fuel particles having an average particle size of about 100 nm to about 1500 nm; and an oxidizer;

wherein the primer composition is essentially devoid of other explosives except for the optional sensitizer and/or a propellant.

28. The primer composition of claim 27, further comprising a sensitizer in an amount of greater than 0 wt-% to about 20 wt-% of the primer composition.

29. The primer composition of claim 28, wherein the sensitizer is tetracene.

30. The primer composition of claim 27, wherein the plurality of fuel particles are chosen from aluminum, boron, molybdenum, silicon, titanium, tungsten, magnesium, melamine, zirconium, calcium silicide, and mixtures thereof.

31. The primer composition of claim 30, wherein the plurality of fuel particles are present in an amount of about 1 wt-% to about 20 wt-% of the primer composition.

32. The primer composition of claim 31, wherein the plurality of fuel particles comprises aluminum.

33. The primer composition of claim 32, wherein said plurality of fuel particles have an average particle size of about 200 nm to about 1000 nm.

34. The primer composition of claim 27, wherein the oxidizer is chosen from bismuth trioxide, bismuth subnitrate, bismuth tetroxide, bismuth sulfide, zinc peroxide, tin oxide, manganese dioxide, molybdenum trioxide, potassium nitrate, and combinations thereof.

35. The primer composition of claim 34, wherein the oxidizer is present in an amount of about 20 wt-% to about 70 wt-% of the primer composition.

36. The primer composition of claim 27, further comprising at least one buffer.

37. The primer composition of claim 27, the at least one buffer chosen from at least one inorganic acid or salt thereof, at least one organic acid or salt thereof, and combinations thereof.

38. The primer composition of claim 27, further comprising a friction generator.

39. The primer composition of claim 38, wherein the friction generator comprises glass powder.

40. The primer composition of claim 27, further comprising a binder.

41. The primer composition of claim 27, further comprising a single-base ground propellant.

42. A primer composition comprising:

an explosive consisting essentially of at least one moderately insensitive explosive in an amount of about 5 wt-% to about 40 wt-% of the primer composition and optionally a sensitizer in an amount of about 0 wt-% to about 20 wt-% of the primer composition, the at least one moderately insensitive explosive chosen from nitrocellulose, pentaerythritol tetranitrate ("PETN"), 2,4,6,8,10,12-hexanitro-2,4,6,8,10,12-hexaazatetracyclo [5.5.0.0.$^{5,9}$0$^{3,11}$]-dodecane ("CL-20"), cyclo-1,3,5-trimethylene-2,4,6-trinitramine ("RDX"), cyclotetramethylene tetranitramine ("HMX"), 2,4,6-trinitrotoluene ("TNT"), nitroguanidine, styphnic acid, potassium dinitrobenzofuroxan ("KDNBF"), and mixtures thereof;

a plurality of fuel particles having an average particle size of about 100 nm to about 1500 nm in an amount of about 1 wt-% to about 20 wt-% of the primer composition; and an oxidizer in an amount of about 20 wt-% to about 70 wt-% of the primer composition;

wherein the primer composition is essentially devoid of other explosives except for the optional sensitizer and/or a propellant.

43. The primer composition of claim 42, further comprising a sensitizer, the sensitizer comprising tetracene in an amount greater than 0 wt-% and less than about 20 wt-% of the primer composition.

44. The primer composition of claim 42, wherein the plurality of fuel particles chosen from aluminum, boron, molybdenum, silicon, titanium, tungsten, magnesium, melamine, zirconium, calcium silicide, and mixtures thereof.

45. The primer composition of claim 44, wherein the oxidizer is chosen from bismuth trioxide, bismuth subnitrate, bismuth tetroxide, bismuth sulfide, zinc peroxide, tin oxide, manganese dioxide, molybdenum trioxide, potassium nitrate, and combinations thereof.

46. The primer composition of claim 45, further comprising aluminum fuel having a size between 80 and 120 mesh.

47. The primer composition of claim 45, further comprising at least one buffer chosen from at least one inorganic acid or salt thereof, at least one organic acid or salt thereof, and combinations thereof.

48. The primer composition of claim 45, further comprising a friction generator.

49. The primer composition of claim 44, further comprising a single-base ground propellant.

50. The primer composition of claim 44, wherein said plurality of fuel particles have an average particle size of about 200 nm to about 1000 nm.

* * * * *